US006212135B1

(12) United States Patent
Schreiber

(10) Patent No.: US 6,212,135 B1
(45) Date of Patent: Apr. 3, 2001

(54) ASSISTIVE BREATHING DEVICE

(76) Inventor: Simeon B. Schreiber, One Beltway North, 10230 New Hampshire Ave., Suite 203, Silver Spring, MD (US) 20903

( * ) Notice: Subject to any disclaimer, the term of this patent is extended or adjusted under 35 U.S.C. 154(b) by 0 days.

(21) Appl. No.: 09/285,713

(22) Filed: Apr. 5, 1999

(51) Int. Cl.[7] ..... G04F 10/00
(52) U.S. Cl. ..... 368/107; 368/109
(58) Field of Search ..... 368/10, 107–113

(56) References Cited

U.S. PATENT DOCUMENTS

| | | |
|---|---|---|
| 3,548,733 | 12/1970 | Buechner . |
| 3,796,040 | 3/1974 | Giersiepen et al. . |
| 3,882,480 | 5/1975 | Greber . |
| 3,893,099 | 7/1975 | Zoepfl . |
| 3,961,473 | 6/1976 | Hung . |
| 4,062,180 | 12/1977 | Meshi et al. . |
| 4,168,525 | 9/1979 | Russell . |
| 4,193,257 | 3/1980 | Watkins . |
| 4,385,841 | 5/1983 | Kramer . |
| 4,451,158 | 5/1984 | Selwyn et al. . |
| 4,491,423 | 1/1985 | Cohen . |
| 4,493,043 | 1/1985 | Forbath . |
| 4,632,570 | 12/1986 | Kelsey . |
| 4,711,585 | 12/1987 | Fresquez et al. . |
| 4,797,864 | 1/1989 | Stano et al. . |
| 5,357,487 | 10/1994 | Coleman, III . |
| 5,559,495 | 9/1996 | Cochran . |
| 5,583,832 | 12/1996 | DePonty . |
| 5,592,143 | 1/1997 | Romney et al. . |
| 5,646,911 | 7/1997 | Davis . |

*Primary Examiner*—Bernard Roskoski
(74) *Attorney, Agent, or Firm*—Sterne, Kessler, Goldstein & Fox, PLLC

(57) ABSTRACT

A device for assisting an individual participating in a focused breathing session consisting of at least one respiration cycle. The device produces a first sensory cue which corresponds to the exhalation phase of the respiratory cycle and a second sensory cue which corresponds to the inhalation phase of the respiratory cycle. The first and second sensory cues are repeatedly produced by the device at a specific rate over the duration of the focused breathing session as selected by the individual or in accordance with a predetermined program. In one embodiment of the device, the sensory cues are visually produced by a light projecting sphere. In another embodiment, the sensory cues are audible.

28 Claims, 6 Drawing Sheets

ASSISTIVE BREATHING DEVICE

BACKGROUND OF THE INVENTION

1. Field of the Invention

The present invention relates to a device for assisting an individual participating in a focused breathing session consisting of a plurality of respiratory cycles. More particularly, the invention relates to a device for repeatedly producing a series of sensory signals to cue the exhalation and inhalation phases of the respiratory cycle.

2. Related Art

Eastern civilizations have long used a system of exercises known as "yoga" to attain bodily or mental control and a basic sense of well-being. It has recently been discovered that one of the yoga exercises known as "belly" breathing, or an adaptation of that breathing technique known as "focused" breathing or respiration, is effective in relieving anxiety, frustration or sadness which can increase blood pressure and trigger myocardial ischemia (inadequate flow of blood through the vessels to the organs of the body) in humans. It has also been found that belly or focused breathing can reduce fatigue, improve sleep, enhance immune system response, assist in the management of chronic pain and reduce the occurrence of hot flashes in menopausal women.

Belly breathing involves sitting quietly, focusing on the breath and slowly allowing air to completely fill the lungs down to the abdomen. Typically, the breath is exhaled at a controlled first pace and inhaled at a controlled second pace with a "pause" of several counts positioned between each exhalation and inhalation of the lungs. The cycle of exhaling, pausing, inhaling and pausing, known as the respiratory cycle, is repeated for a period of time, for example, ten to twenty minutes. The objective of belly breathing is to reduce the number of respiration cycles to approximately 1–2 per minute to control the rate of respiration and relax the body. It appears that with little practice the typical respiration rate of an adult can be reduced from 15–16 cycles per minute to 8–9 using the belly breathing technique. By incorporating belly or focused breathing into an individual's daily schedule it is envisioned that mental and physical health can be improved, resulting in greater productivity and an enhanced sense of well-being.

Although it is difficult to dispute the benefits of physical and respiratory exercise, many adults still lack the time to incorporate a focused breathing session into their daily routines or to at least clear their minds of extraneous matter to control or focus on the respiratory cycle. Thus, there appears to be a need for a breathing device which assists in control of the rate and duration of the respiration cycle and which can be transported and stored in a variety of locations for use at any time and at any place when the user finds that he or she has time to engage in a focused breathing session.

Devices for assisting with certain breathing patterns are known in the art. For example, U.S. Pat. No. 4,711,585 to Fresquez et al. discloses a cueing aid for prenatal breathing control. The device provides a number of cueing signals to an expectant mother so that she can synchronize her breathing to one of three predetermined shallow breathing techniques. The device comprises a timer, a start-stop switch, a breathing technique selector switch, a first illuminating lamp to cue inhalation and a second illuminating lamp to cue exhalation. While the device of the Fresquez et al. patent assists a pregnant woman with the established shallow breathing techniques associated with natural childbirth, the device is not suitable for assisting an individual who wishes to participate in a focused breathing session. More particularly, the predetermined breathing patterns of the Fresquez et al. patent are synchronized to cue shallow chest breathing, rather than deep belly breathing, and the device fails to indicate the rate at which the user is to exhale and inhale during the respiration cycles of the breathing pattern. Furthermore, the device of the Fresquez et al. patent makes use of a first illuminating lamp to cue inhalation and a second illuminating lamp to cue exhalation which demands that the user divide his or her attention between a first lamp and a second lamp, which can prove to be counterproductive to the user's efforts to control the breathing pattern. Moreover, the device of the Fresquez et al. patent does not enable the user to select a respiration ratio or duration to create a focused breathing session customized to the needs and skill level of the user. The only time interval that the Fresquez et al. device can track is the duration of a labor contraction and the length of time between two contractions to assist in the selection of one of the three shallow breathing techniques.

Another device for timing labor contractions is disclosed in U.S. Pat. No. 4,493,043 to Forbath. The Forbath device comprises a medical timing system with a programmed computer controlled display, an audible buzzer, and a timing switch. Using the device of the Forbath patent, an expectant mother is able to time her labor pains, count fetal movements and practice breathing patterns to relieve contractions. Unfortunately, the Forbath patent suffers from the same disadvantages as the Fresquez et al. patent, in that the device does not enable the user to select an individualized focused breathing session having a series of exhalation, exhalation pause, inhalation and inhalation pause cues produced and signaled to the user at a user-selected rate and duration.

U.S. Pat. No. 4,491,423 to Cohen discloses a resuscitation assistive timer to provide audio or visual cues to a person attempting to resuscitate a pediatric or adult. The device generates short audio and visual signals to indicate the compression and breathing phases of mouth-to-mouth resuscitation. While the Cohen device visually or audibly counts the compression and breathing phases of the resuscitation technique, it does not enable the user to customize a focused breathing session based on a user-selected respiration ratio. In addition, none of the prior art devices make use of a cueing device which facilitates visualization of the exhalation and inhalation phases of the respiration cycle to enhance the user's ability to focus on his or her own breathing pattern.

Thus, it is an object of the invention to provide an assistive breathing device which assists an individual participating in a focused breathing session by producing and signaling cues which correspond to the inhalation, exhalation and pause phases of the respiration cycle.

It is another object of the invention to provide an assistive breathing device which cues the rate and duration of each phase of the respiration cycle to the individual.

It is still another object of the invention to provide an assistive breathing device which produces visual as well as audible cues.

It is still another object of the invention to provide an assistive breathing device which produces a cue which facilitates visualization of the inhalation and exhalation phases of the respiration cycle to enable the individual to focus on his or her breathing pattern.

Still another object of the invention is to provide an assistive breathing device which enables the individual to select the parameters of the focused breathing session in accordance with the individual's skill level.

It is still another object of the invention to provide an assistive breathing device which is portable.

SUMMARY OF THE INVENTION

It was with the preceding needs and disadvantages in mind that the present invention was developed. In one aspect, the invention is a device for assisting a user participating in a focused breathing session consisting of at least one respiration cycle comprising an exhalation phase and an inhalation phase. The device comprises a power source, a switch coupled to the power source for energizing the device, a visual cueing means coupled to the switch, and control means coupled to the visual cueing means and the switch for repeatedly energizing the visual cueing means. The visual cueing means produces a visual exhalation cue of a first rate and duration which corresponds to the exhalation phase of the respiration cycle and a visual inhalation cue of a second rate and duration which corresponds to the inhalation phase of the respiration cycle. The control means repeatedly energizes the visual cueing means to signal the first rate at which the user exhales during the first duration of the exhalation cue and to signal the second rate at which the user inhales during the second duration of the inhalation cue. The control means determines the number of respiratory cycles to be repeatedly cued to the user based on the duration of the focused breathing session.

The device may include a timer to enable the user to select the duration of the focused breathing session or it may include means to enable the user to select the duration of the visual exhalation cue and the duration of the visual inhalation cue. The visual cueing means may be a light projecting sphere or a plurality of lamps.

The device may also include an audible cueing means coupled to the switch and to the control means to produce an audible exhalation cue to signal the exhalation phase of the respiration cycle and an audible inhalation cue to signal the inhalation phase of the respiration cycle. The audible cueing means is energized by the control means in tandem with the visual cueing means of the device.

In another aspect, the invention is a device for cueing an exhalation phase and an inhalation phase of a respiration cycle of a focused breathing session comprising a power source, a switch coupled to the power source for energizing the device, and a single cueing means. The single cueing means produces a first sensory cue of a first rate and duration corresponding to the exhalation phase of the respiration cycle and a second sensory cue of a second rate and duration corresponding to the inhalation phase of the respiration cycle. The single cueing means is repeatedly energized to produce the first sensory cue to signal the first rate at which the user exhales over the duration of the first sensory cue and to produce the second sensory cue to signal the second rate at which the user inhales over the duration of the second sensory cue. The single cueing means may be a light projecting sphere or a plurality of diodes which produces visual cues. The device may also comprise an audible cueing means which is energized in tandem with the single cueing means.

The device may also comprise control means for repeatedly energizing the single cueing means. The control means determines the first rate at which the single cueing means is energized based on the first duration of the first sensory cue and the second rate at which the single cueing means is energized based on the second duration of the second sensory cue.

The respiration cycle of the focused breathing session may comprise an exhalation pause following the exhalation phase and an inhalation pause following the inhalation phase. The single cueing means may produce a third sensory cue corresponding to the exhalation pause of the respiration cycle and a fourth sensory cue corresponding to the inhalation pause of the respiration cycle.

The device may include means for enabling the user to select the duration of the first sensory cue and the duration of the second sensory cue. It may also include a timer to enable the user to select the duration of the focused breathing session.

In still another aspect, the invention is a device for cueing a bodily function comprising a power source, a switch coupled to the power source for energizing the device, cueing means coupled to the switch, and control means coupled to the cueing means and the switch. The cueing means produces a first sensory cue of a first rate and a first duration followed by a second sensory cue of a second rate and a second duration. The control means repeatedly energizes the cueing means to produce the first sensory cue and the second sensory cue to signal to a user how to perform the bodily function.

The bodily function may be respiration, the first sensory cue may correspond to exhalation and the second sensory cue may correspond to inhalation.

The first and second sensory cues may be visual or audible. The cueing means may be a light source.

The device may include means to enable the user to select the first duration of the first sensory cue and the second duration of the second sensory cue.

BRIEF DESCRIPTION OF THE FIGURES

Various objects, features and attendant advantages of the present invention can be more fully appreciated as the same becomes better understood from the following detailed description of the present invention when considered in connection with the accompanying drawings, in which.

DETAILED DESCRIPTION OF THE PREFERRED EMBODIMENTS

The present invention is a device to assist an individual participating in a focused breathing session. For description purposes, a focused breathing session is a period of time comprising at least one respiration cycle. A respiration cycle comprises at least one exhalation phase and at least one inhalation phase. The respiration cycle preferably comprises an exhalation pause phase which follows termination of the exhalation phase and precedes initiation of the inhalation phase and an inhalation pause phase which follows termination of the inhalation phase and precedes initiation of the next exhalation phase. Over the duration of the exhalation phase, the user exhales or expels the total volume of air contained in the lungs in a controlled manner. Over the duration of the exhalation pause phase, the user "holds" the muscles of the abdominal wall and diaphragm in the exhale-out position to prevent air from re-entering the lungs. Over the duration of the inhalation phase, the user inhales to fill the lungs to capacity with air, extending the diaphragm to the abdomen (commonly known as "belly" breathing). During the inhalation pause phase, the user "holds" the air which has been drawn into the lungs over the inhalation phase.

Figure 1:
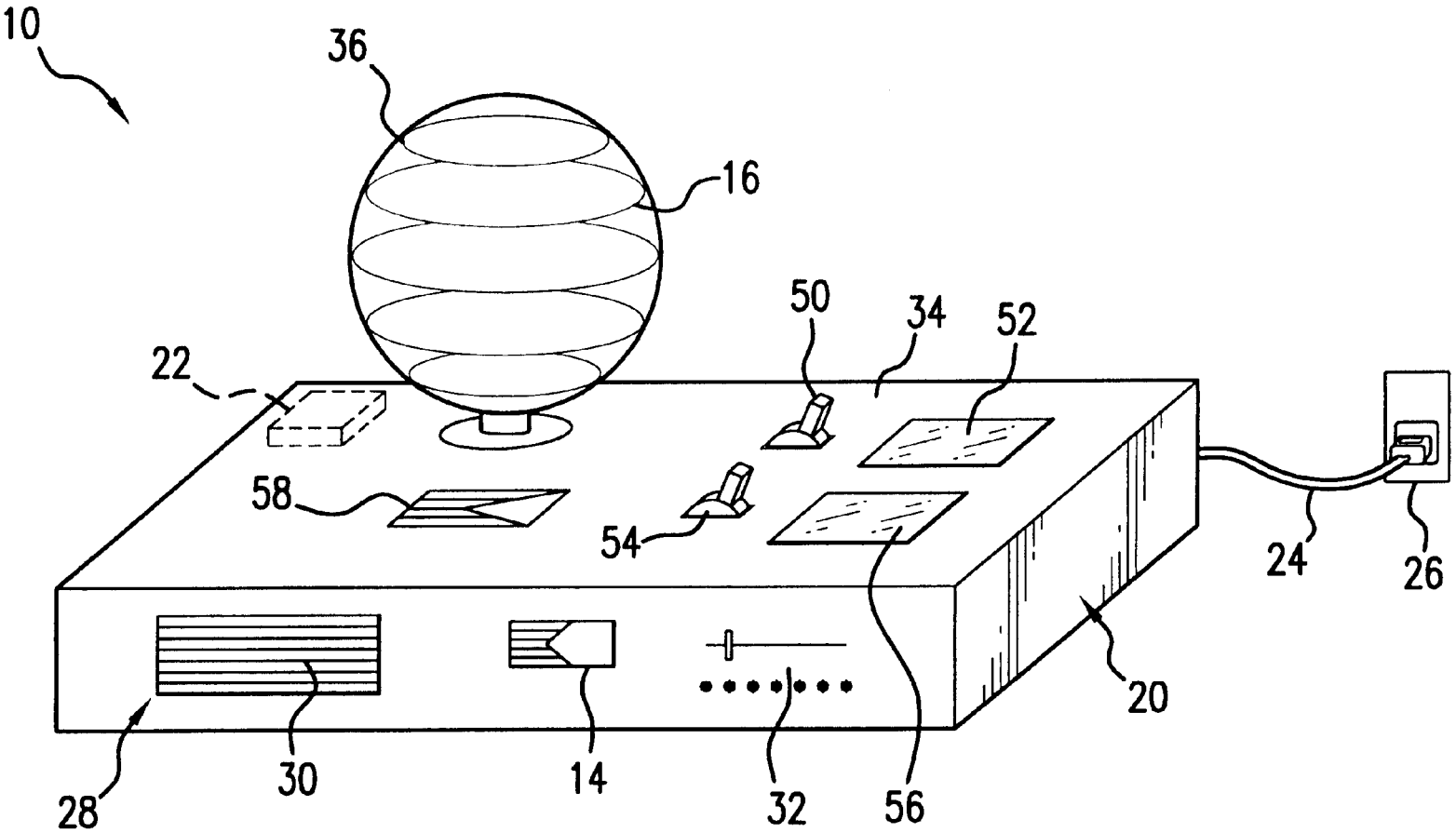
FIG. 1 is a perspective view of the assistive breathing device of the present invention.
Figure 2:
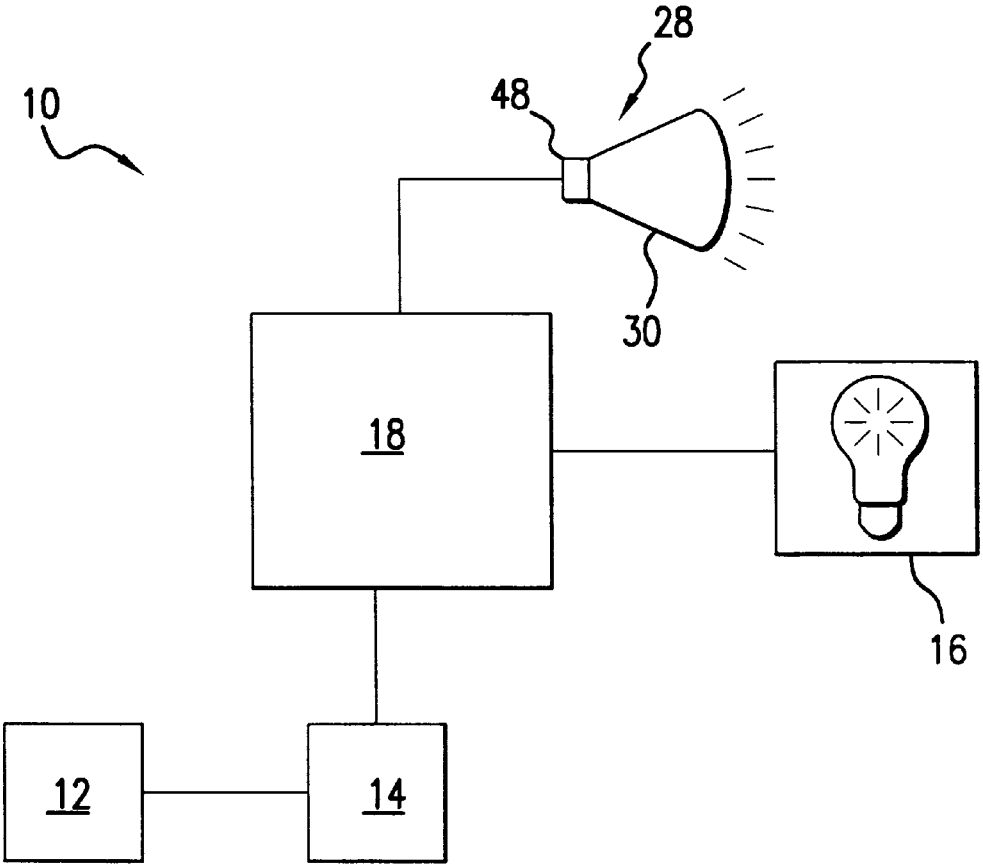
FIG. 2 is a schematic of the components of the device shown in FIG. 1.

With reference to the attached figures, the assistive breathing device of the present invention is shown generally at 10 in FIGS. 1 and 2. Breathing device 10 generally comprises a power source 12, an on-off switch 14, a cueing means 16, a control means 18 and a housing 20. Power source 12 may be a battery 22 disposed interior of housing 20 and in electrical contact with the remaining components of the device. Alternatively, power may be supplied to the device by a cord 24 in contact with a source of alternating current 26.

Housing 20 is rectangular in shape and formed from a material capable of protecting the internal components of the device from damage. Housing 20 may be constructed of metal or it may be molded from hard plastic. Although the housing is shown as rectangular in shape, it should be apparent to those skilled in the art that housing 20 may take any shape or size so long as it is capable of containing and protecting the components of the device from damage.

On-off switch 14 can be any type of on-off power switch known to those skilled in the art of electronics. The switch is electrically connected to power source 12 and to the remaining electrical components of device 10. As shown in FIG. 1, the switch is mounted through the front panel of housing 20.

Cueing means 16 is mounted to device 10 through upper surface 34 of housing 20. Cueing means 16 produces a series of cues of a selected rate and duration which correspond to the exhalation phase, the exhalation pause phase, the inhalation phase, and the inhalation pause phase of the respiration cycle of the focused breathing session. As shown in FIGS. 1 and 2, cueing means 16 is a light source which produces cues that are visually sensed by the user (i. e., visual cues). In the preferred embodiment of the invention, cueing means 16 produces an exhalation cue and an inhalation cue which mimics the natural contraction and expansion of the lungs during respiration to assist the user in visualizing and focusing on the exhalation and inhalation phases of the respiration cycle. Light source 36 shown in FIG. 1 of the drawings is especially effective at facilitating visualization of the respiration cycle by the user. Light source 36 is a light sphere which utilizes a laser to create a plurality of light rings illuminated from the bottom of the sphere to the top or to project a light from within the interior of the sphere to the exterior. As the visual exhalation cue is produced, light source 36 is de-illuminated from the top of the sphere to the bottom to mimic the exhalation or expelling of air from the lungs. As the visual inhalation cue is produced, light source 36 is illuminated from the bottom of the sphere to the top to mimic the inhalation of air into the lungs. Throughout the duration of the exhalation pause phase, the sphere is fully and continuously de-illuminated. Throughout the duration of the inhalation pause phase, the sphere is fully and continuously illuminated. Given the three-dimensional shape of light source 36 and the manner in which light is produced in the sphere to "fill up" its volume, it is a simple matter for the user to visualize the exhalation and inhalation phases of the respiration cycle while focusing on the cueing means of the device. Such a spherical light is available from Can You Imagine, Inc. of Chatsworth, Calif. under the LIGHT DOODLER trademark.

Figure 4A:
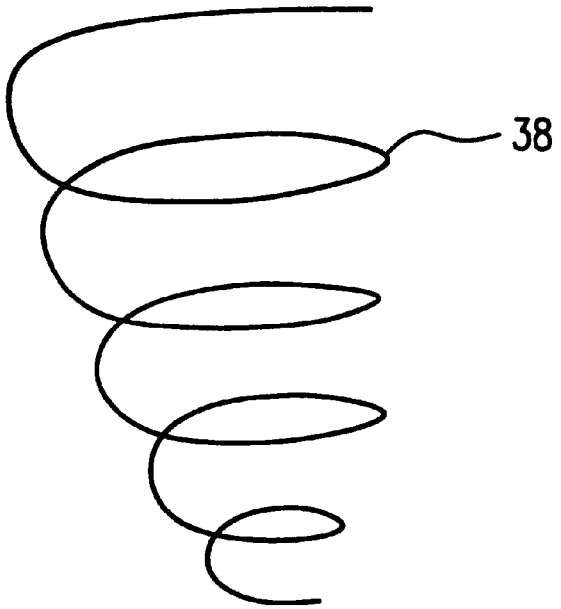
FIG. 4A is an alternate embodiment of the visual cueing means shown in FIG. 1.

Although a spherical light source is shown in FIG. 1, it should be apparent that other light sources could be employed to produce the visual cues of the invention. Other light sources and arrangements capable of accomplishing the visualization objective of the invention appear in FIGS. 4A–4D of the drawings. FIG. 4A illustrates a light source 38, for example, a neon tube, arranged in a spiral or coil which increases in diameter from the upper surface of housing 20 to the top of the tube. As the visual exhalation cue is produced, the tube is de-illuminated from the top to the bottom. As the visual inhalation cue is produced, the tube is illuminated from the bottom to the top. Throughout the duration of the visual exhalation pause cue, the tube is fully and continuously de-illuminated and throughout the duration of the visual inhalation pause cue, the tube is fully and continuously illuminated.

Figure 4B:
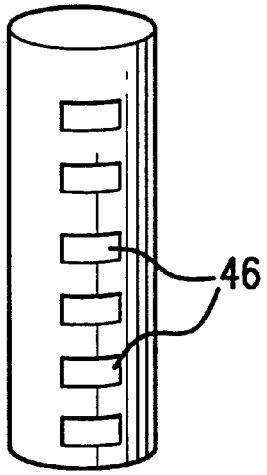
FIG. 4B is another embodiment of the visual cueing means shown in FIG. 1.

FIG. 4B illustrates a plurality of vertically arranged lamps 46 illuminated in a manner similar to that described above with respect light source 36 and light source 38 to produce the exhalation, inhalation, and exhalation and inhalation pause cues of the invention.

Figure 4C:
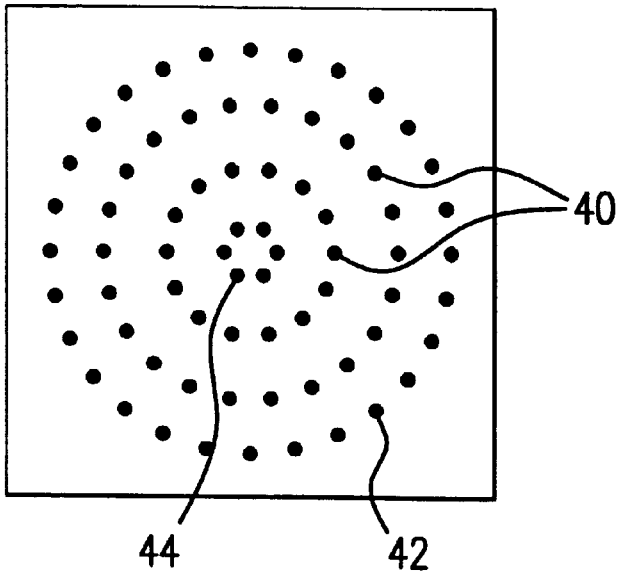
FIG. 4C is another embodiment of the visual cueing means shown in FIG. 1.
Figure 4D:
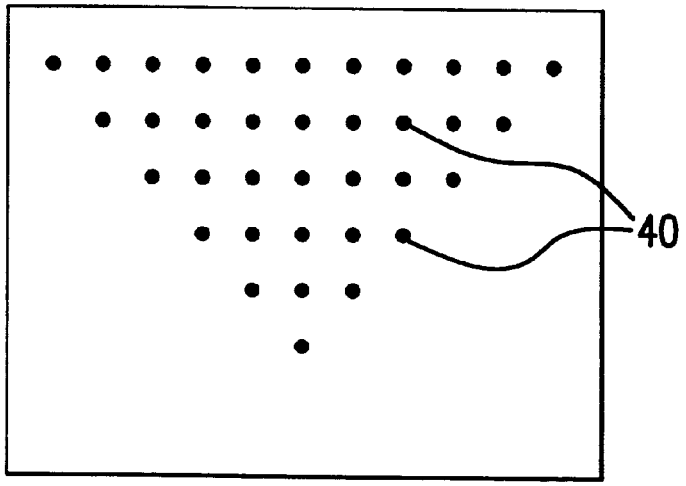
FIG. 4D is another embodiment of the visual cueing means shown in FIG. 1.

FIGS. 4C and 4D both illustrate a plurality of light emitting diodes 40 arranged to simulate contraction and expansion of the lungs as the diodes are illuminated and de-illuminated. In FIG. 4C, the diodes are arranged in concentric circles to mimic the act of exhalation as the diodes are de-illuminated from outermost ring 42 to innermost ring 44, and to mimic the act of inhalation as the diodes are illuminated from innermost ring 44 to outermost ring 42. In FIG. 4D, the diodes are arranged in an inverted pyramid configuration to simulate the act of exhalation as the diodes are de-illuminated from the upper row to the single diode of the bottom row and to simulate the act of inhalation as the diodes are illuminated from the bottom row to the upper row. Like light source 46, all of the diodes of FIGS. 4C and 4D are fully and continuously de-illuminated during the exhalation pause cue to signal the exhalation pause phase of the respiration cycle and fully and continuously illuminated during the inhalation pause cue to signal the inhalation pause phase.

Figure 5:
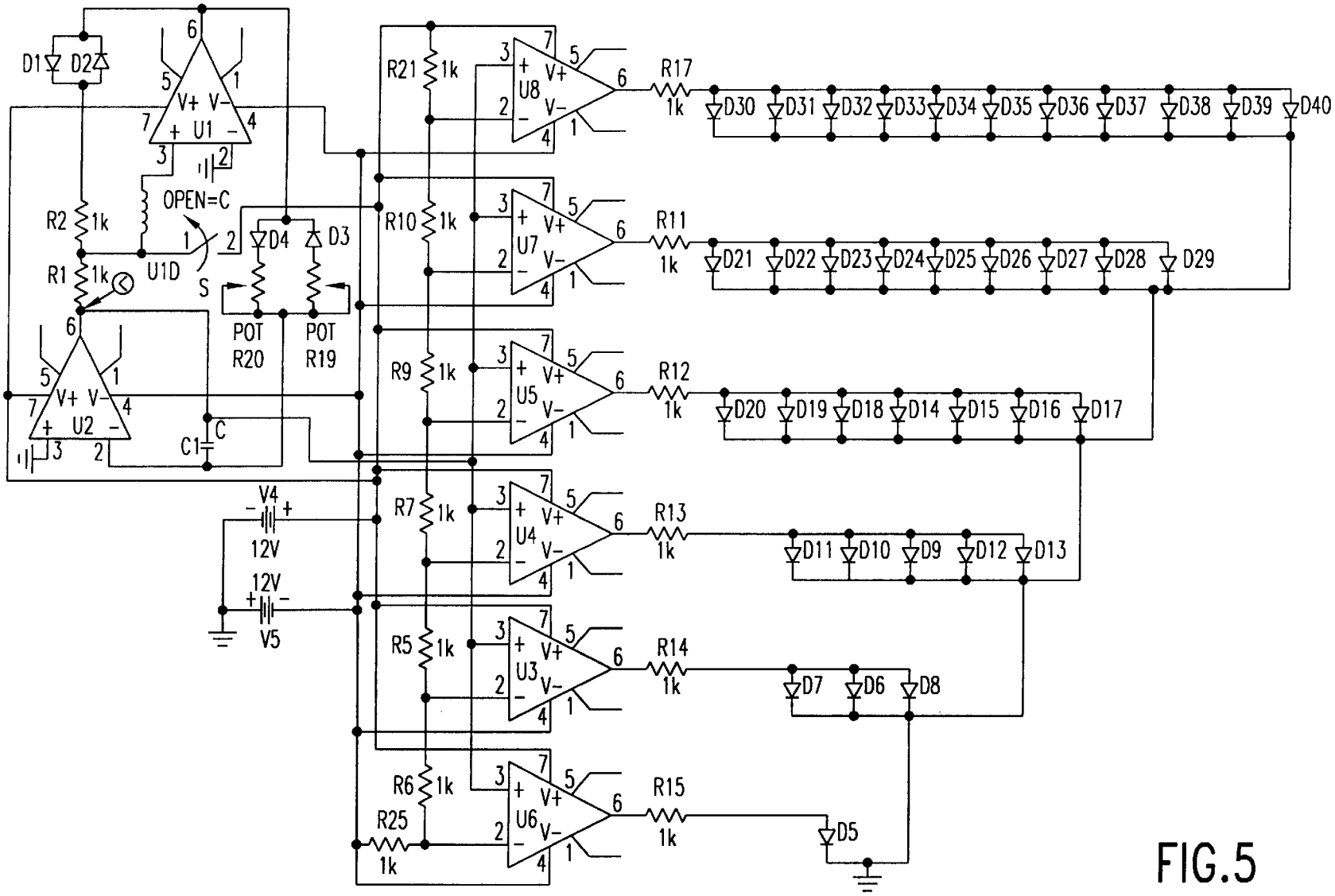
FIG. 5 is a circuit diagram for the visual cueing means shown in FIG. 4C.

A circuit diagram for the diode arrangement of FIG. 4C is illustrated in FIG. 5. FIG. 5 illustrates diodes D5–D40 which are de-illuminated and illuminated in accordance with control means 18 discussed in more detail below. Control means 18 activates a switch S to charge and discharge a capacitor C to send a voltage to resistors R6, R5, R7, R9, R10, R2 of the circuit. Depending on the voltage at operational amps UA3-UA8, diodes D5–D40 are either de-illuminated or illuminated in accordance with control means 18. Although circuit diagrams for the other light sources and arrangements of the invention have not been described, it is to be understood that the design of such circuits would be apparent to those skilled in the art.

It is to be noted that the device of the present invention is provided with only a single light source which produces all four cues of the respiration cycle. By producing and signaling all cues with a single light source, the user need not divide or re-focus his or her gaze between multiple light sources which could impair the user's ability to maintain the appropriate level of concentration to derive the benefits of the focused breathing session.

Furthermore, while specific light sources have been described above, it should realized by those skilled in the art that other light sources disposed in other arrangements can be utilized to produce the cues of the invention. It is further envisioned that the light source of cueing means 16 could be colorized to provide cues of a soothing and relaxing color (or combination of colors) to the user.

In another embodiment of the invention, breathing device 10 is provided with an audible cueing means 28 to produce and signal audible cues in tandem with the visual cueing means of the invention. As shown in FIGS. 1 and 2, audible cueing means 28 comprises a tone module 48 and a speaker 30 mounted through the front wall of housing 20. A volume control 32 also mounted through the front wall of housing 20 is provided to adjust the volume of audible cueing means 28. Tone module 48 produces a tone of a variable pitch. Like cueing means 16, audible cueing means 28 preferably facilitates mental visualization of the exhalation and inhalation phases of the respiration cycle by the user. To audibly cue the exhalation phase, tone module 48 produces a tone which transitions from a high pitch to a low pitch. To audibly signal the inhalation cue, the tone module produces a tone which transitions from a low pitch to a high pitch. Over the duration of the exhalation pause cue, the pitch of the cueing tone is held at the lowest pitch of the exhalation cue. Over the duration of the inhalation pause cue, the pitch of the cueing tone is held at the highest pitch of the inhalation cue. It is also envisioned that the audible cueing means could produce a pulsed tone, rather than a variable pitched tone, which corresponds to the exhalation, exhalation pause, inhalation and inhalation pause cues of the invention.

Activation of cueing means 16 is controlled by control means 18 of the device (FIG. 2). It is to be understood that the electrical components which govern operation of the control means could be integrated circuits capable of being designed by those skilled in the art in a variety of configurations. In another embodiment of the invention, the control and timing operations of control means 18 discussed below could be performed by a microprocessor.

Control means 18 determines the number of respiration cycles (i.e., the number of exhalation, exhalation pause, inhalation, and inhalation pause phases) to be repeatedly cued to the user based on the duration of the focused breathing session. For example, if the user desires to participate in a focused breathing session of thirty minutes at a respiration ratio of 10:5:10:5 (i.e., an exhalation phase of 10 seconds, an exhalation pause phase of 5 seconds, an inhalation phase of 10 seconds, and an inhalation pause phase of 5 seconds), control means 18 would energize cueing means 16 to produce 60 cueing cycles, with each cueing cycle comprising an exhalation cue of 10 seconds, an exhalation pause cue of 5 seconds, an inhalation cue of 10 seconds, and an inhalation pause cue of 5 seconds. In addition to determining the number of respiration cycles to be produced and cued to the user, control means 18 also determines the rate at which each cue of the respiration cycle is produced and signaled to the user based on the duration of the exhalation, exhalation pause, inhalation, and inhalation pause phases. The rate activation feature of the control means is important in that it provides the user with a visual cue to signal the rate at which the user should exhale and inhale. The purpose of focused breathing is to concentrate on and to control the respiration cycle. By providing a visual cue of the rate at which the user is to exhale and inhale, the user can synchronize his or her exhalation and inhalation rates to the visual cues produced by the light source to develop and maintain a controlled breathing pattern.

Figure 3:
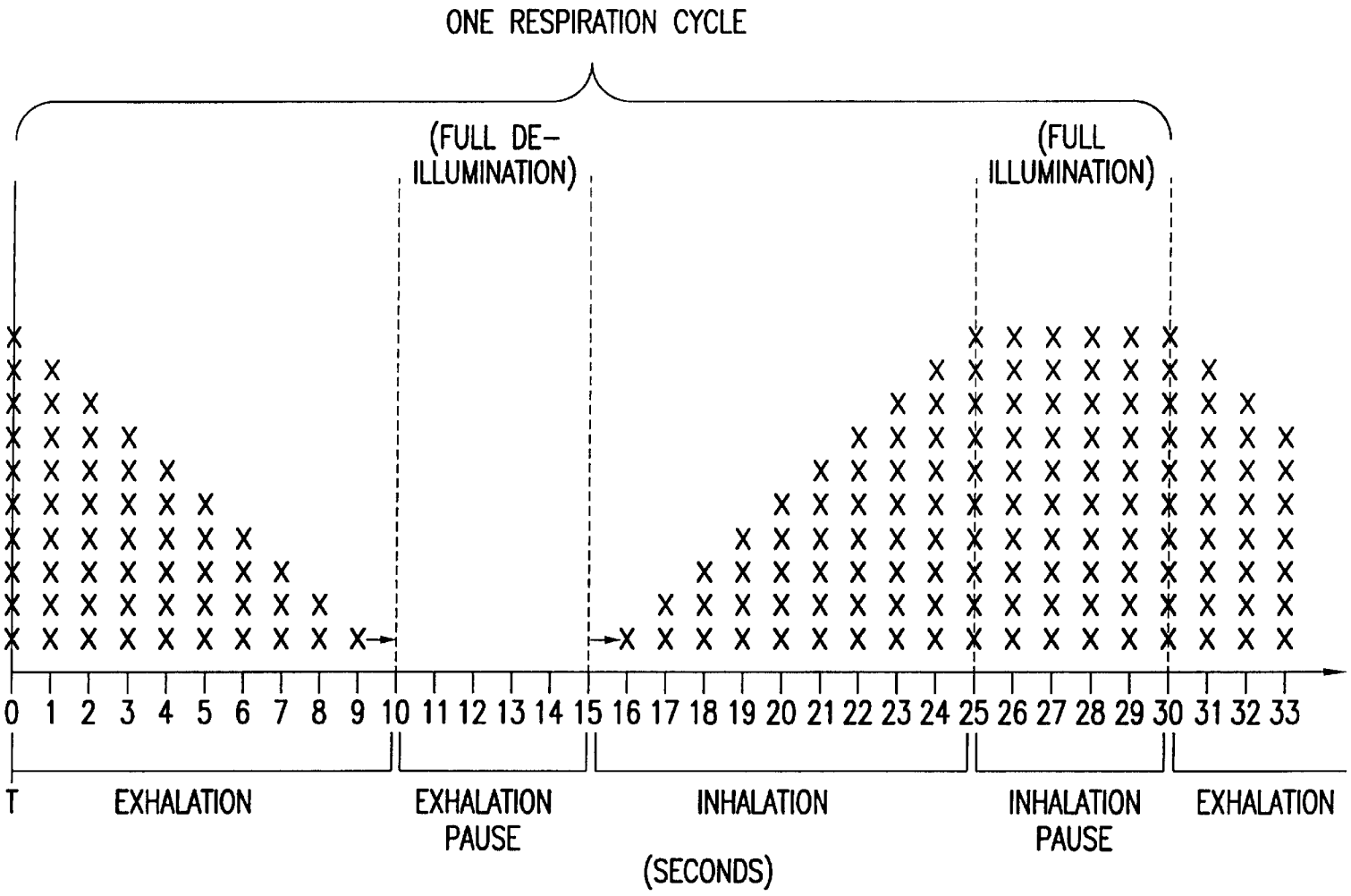
FIG. 3 is a diagram illustrating the rate at which the visual cueing means of FIG. 1 produces the exhalation cue, the exhalation pause cue, the inhalation cue and the inhalation pause cue corresponding to the exhalation, exhalation pause, inhalation, and inhalation pause phases, respectively, of the respiration cycle.

FIG. 3 illustrates the rate at which control means 18 activates visual cueing means 16 to produce and signal the visual exhalation, exhalation pause, inhalation, and inhalation pause cues of the respiration cycle in accordance with the 10:5:10:5 respiration ratio discussed above. The duration of the focused breathing session is shown horizontally, in part, along the bottom of the figure, while the rate of activation of the cueing means is shown vertically, in part, along the side of the figure. In the figure, each x represents illumination, for example, of a light ring shown in the device of FIG. 1. To initiate the exhalation cue, control means 18 completely illuminates the light source of visual cueing means 16 to signal that the lungs should be filled to capacity and that the user should be ready to exhale. To produce the exhalation cue, control means 18 activates visual cueing means 16 in a manner so that the light source is de-illuminated at a constant rate of one-tenth per second until the visual cueing means is fully de-illuminated. The exhalation pause is cued following termination of the exhalation cue by continuous and full de-illumination of the light source for 5 seconds. Following termination of the exhalation pause cue, the inhalation phase is cued and control means 18 activates visual cueing means 16 in a manner so that the light source is illuminated at a constant rate of one-tenth per second until the visual cueing means is completely illuminated. The inhalation pause is cued following termination of the inhalation cue by continuous and full illumination of the light source for 5 seconds. At the conclusion of the inhalation pause phase, control means 18 re-activates cueing means 16 to repeatedly signal the exhalation, exhalation pause, inhalation and inhalation pause cues to the user at the rate and duration previously determined and controlled by the control means for the duration of the focused breathing session.

The user may select the parameters of the focused breathing session or the user may choose among a number of predetermined programs stored in control means 18 of the device. The following parameters may be selected by the user: the duration of the focused breathing session, the count of the exhalation phase (preferably ranging from 10–40 seconds), the count of the exhalation pause phase (preferably ranging from 2–5 seconds), the count of the inhalation phase (preferably ranging from 10–30 seconds), and the count of the inhalation pause phase (preferably ranging from 2–10 seconds). Although the "counts" of the exhalation, exhalation pause, inhalation and inhalation pause phases of the respiration cycle have been described above in terms of seconds, the counts may be calibrated in other units of time.

With reference again to FIG. 1, a mode selecting push-button 50 is mounted through the upper surface of housing 20 to enable the user to scroll through the parameter-setting modes of the device (that is, the duration parameter, the exhalation count parameter, the exhalation pause count parameter, the inhalation count parameter and the inhalation pause count parameter). The mode selected by the user is displayed in a liquid crystal display (LCD) 52 also mounted through the upper surface of the housing. To change the mode of the device, the user simply depresses push-button switch 50 until the desired parameter is displayed in LCD 52. To select the duration of the breathing session or to select the count of any one of the respiration phases, the user depresses a rocker switch 54 until the desired time or count appears in LCD 52. The user continues to scroll through the modes of the device until a selection has been made for all of the parameters of the control device. A timer for the device is disposed within housing 20 of device 10. The timer display 56 is mounted through the upper surface of housing 20 for visualization by the user. When the user wishes to begin, terminate or interrupt the focused breathing session, the user depresses a start-stop switch 58 located in front of cueing means 16 and mounted through the upper surface of housing 20. If the user intends to use audible cueing means 28 together with the visual cueing means of the invention, the same parameters for the visual cueing means are also set for the audible cueing means using mode switch 50 and rocker switch 54 so that the audible cueing means will be activated in tandem with the visual cueing means of the device.

In the event that the user is new to the focused breathing technique, the user could select among a number of predetermined respiration ratios and durations saved in the memory of the control means and accessible to the user by mode switch 54.

Thus, to use the assistive breathing device of the present invention, the user simply turns power switch 14 to the on position, selects the parameters and duration of the focused breathing session by depressing switches 50 and 54 as needed, activates start-stop switch 58, and focuses his or her attention on cueing means 16. With the start of the focused breathing session, control means 18 determines the number of respiration cycles to be cued to the user based on the duration of the focused breathing session and the respiration ratio selected by the user. After assessing the number of respiration cycles to be cued to the user during the focused breathing session, control means 16 determines the rate at which the exhalation, exhalation pause, inhalation and inhalation pause cues are to be signaled to the user and it repeatedly activates the cueing means in accordance with the previously assessed rate and duration. If the user also activates the audible cueing means, the audible exhalation, exhalation pause, inhalation and inhalation pause cues are tandemly produced and signaled to the user at the same rate and duration of the visual exhalation, inhalation and pause cues.

Using the assistive breathing device of the present invention, a user can train his or herself to breath in a focused and controlled manner to alleviate stress and to ameliorate symptoms associated with stress-related conditions to lead a more healthful life. By training with the assistive breathing device of the present invention, it is anticipated that a user can decrease the number of respiratory cycles per minute from 15–16 to 1–2 to improve the user's health and overall sense of well-being.

Having described the preferred embodiment of the invention in detail above, it will be apparent to those skilled in the art that modifications to the device and structural alternatives can be practiced without departing from the spirit of the invention. For example, it is envisioned that the assistive breathing device of the present invention could be made portable by incorporating the structure in a pendant, wrist watch, or pen for use at the workplace or while traveling.

Furthermore, while push-button and rocker switches and LCD screens have been described for device 10, it should be understood that knobs, dials, LED screens and other selectors and indicators are equally suitable for achieving the purposes of the invention. It is also envisioned that the exhalation pause and inhalation pause cues could be signaled to the user in a blinking-light form, rather than as full and continuous de-illumination or illumination of the light source.

The scope of the invention is defined by the following claims.

What is claimed is:

1. A device for assisting a user to participate in a focused breathing session consisting of at least one respiration cycle comprising an exhalation phase and an inhalation phase, said device comprising:

a power source;

a switch coupled to said power source for energizing said device;

visual cueing means coupled to said switch for producing a visual exhalation cue of a first rate and a first duration corresponding to the exhalation phase of the respiration cycle followed by a visual inhalation cue of a second rate and a second duration corresponding to the inhalation phase of the respiration cycle; and control means coupled to said visual cueing means and to said switch for repeatedly energizing said visual cueing means to produce said visual exhalation cue to signal said first rate at which the user exhales during said first duration of said exhalation cue and to produce said visual inhalation cue to signal said second rate at which the user inhales during said second duration of said inhalation cue.

2. The device of claim 1 further comprising means to enable the user to select said first duration of said visual exhalation cue and said second duration of said visual inhalation cue.

3. The device of claim 2 further comprising a timer to enable the user to select the duration of the focused breathing session.

4. The device of claim 3, wherein said control means determines the number of respiration cycles to be repeatedly cued to the user based on the duration of the focused breathing session.

5. The device of claim 1, wherein said visual cueing means comprises a light projecting sphere.

6. The device of claim 1, wherein said visual cueing means comprises a plurality of lamps.

7. The device of claim 1 further comprising audible cueing means coupled to said switch and to said control means for producing an audible exhalation cue to signal the exhalation phase of the respiration cycle and an audible inhalation cue to signal the inhalation phase of the respiration cycle.

8. The device of claim 7, wherein said audible cueing means is energized by said control means in tandem with said visual cueing means.

9. The device of claim 1, wherein said first duration of said visual exhalation cue is greater than said second duration of said visual inhalation cue.

10. The device of claim 1, wherein the respiration cycle of the focused breathing session further comprises an exhalation pause following the exhalation phase and preceding the inhalation phase and an inhalation pause following the inhalation phase and preceding the exhalation phase, and wherein said visual cueing means further produces a visual exhalation pause cue and a visual inhalation pause cue.

11. A device for cueing an exhalation phase and an inhalation phase of a respiration cycle of a focused breathing session, comprising:

a power source;

a switch coupled to said power source for energizing the device; and a single cueing means coupled to said switch for producing a first sensory cue of a first rate and a first duration corresponding to the exhalation phase of the respiration cycle and a second sensory cue of a second rate and a second duration corresponding to the inhalation phase of the respiration cycle;

wherein said single cueing means is repeatedly energized to produce said first sensory cue to signal to a user said first rate at which the user exhales during said first duration of said first sensory cue corresponding to the exhalation phase and to produce said second sensory cue to signal to the user said second rate at which the user inhales during said second duration of said second sensory cue corresponding to the inhalation phase.

12. The device of claim 11, wherein said cueing means produces visual cues.

13. The device of claim 12, wherein said cueing means comprises a light projecting sphere.

14. The device of claim 12, wherein said cueing means comprises a plurality of light emitting diodes.

15. The device of claim 11, wherein the respiration cycle of the focused breathing session further comprises an exhalation pause following the exhalation phase and preceding the inhalation phase and an inhalation pause following the inhalation phase and preceding the exhalation phase and wherein said cueing means further produces a third sensory cue corresponding to the exhalation pause of the respiration cycle and a fourth sensory cue corresponding to the inhalation pause of the respiration cycle.

16. The device of claim 12, wherein said cueing means produces audible cues.

17. The device of claim 11 further comprising control means for repeatedly energizing said cueing means.

18. The device of claim 17, wherein said control means determines said first rate at which said cueing means is energized based on said first duration of said first sensory cue and said control means determines said second rate at which said cueing means is energized based on said second duration of said second sensory cue.

19. The device of claim 18 further comprising means for enabling the user to select said first duration of said first sensory cue and said second duration of said second sensory cue.

20. The device of claim 19 further comprising a timer to enable the user to select the duration of the focused breathing session.

21. The device of claim 18, wherein said control means selects said first duration of said first sensory cue and said second duration of said second sensory cue.

22. A device for assisting a user participating in a focused breathing session consisting of at least one respiration cycle comprising an exhalation phase and an inhalation phase, said device comprising:

a power source;

a switch coupled to said power source for energizing said device;

cueing means coupled to said switch for producing an exhalation cue of a first rate and first duration corresponding to the exhalation phase of the respiration cycle followed by an inhalation cue of a second rate and second duration corresponding to the inhalation phase of the respiration cycle; and control means coupled to said cueing means and to said switch for repeatedly energizing said cueing means to produce said exhalation cue to signal said first rate at which the user exhales during said first duration of said exhalation cue and to produce said inhalation cue to signal said second rate at which the user inhales during said second duration of said inhalation cue.

23. The device of claim 22 further comprising means to enable the user to select said first duration of said exhalation cue and said second duration of said inhalation cue.

24. The device of claim 23 further comprising a timer to enable the user to select the duration of the focused breathing session.

25. The device of claim 22, wherein the respiration cycle of the focused breathing session further comprises an exhalation pause following the exhalation phase and preceding the inhalation phase and an inhalation pause following the inhalation phase and preceding the exhalation phase, and wherein said cueing means further produces an exhalation pause cue and an inhalation pause cue.

26. The device of claim 22, wherein said cueing means produces a visual exhalation cue and a visual inhalation cue.

27. The device of claim 26, wherein said cueing means comprises at least one lamp.

28. The device of claim 22, wherein said cueing means produces an audible exhalation cue and an audible inhalation cue.

* * * * *